US005724021A

United States Patent [19]

Perrone

[11] Patent Number: 5,724,021

[45] Date of Patent: Mar. 3, 1998

[54] SELF-CONTAINED, PROGRAMMABLE, TIME INTERVAL ALARM REMINDER DEVICE FOR EYEDROP MEDICATION ADMINISTRATION AND A MEANS FOR AFFIXING SUCH TO EYEDROP/ MEDICATION CONTAINER

[75] Inventor: Stephen C. Perrone, 68-55 Fresh Pond Rd., Ridgewood, Queen, N.Y. 11385

[73] Assignee: Stephen C. Perrone, Ridgewood, N.Y.

[21] Appl. No.: 676,544

[22] Filed: Jul. 9, 1996

[51] Int. Cl.[6] ..... G08B 3/00

[52] U.S. Cl. ..... 340/309.15; 368/10; 221/2; 221/3; 221/15; 272/420; 604/295

[58] Field of Search ..... 340/309.15, 573, 340/309.4, 309.5; 368/10, 2; 221/2, 3, 15; 604/295, 300; 222/420

[56] References Cited

U.S. PATENT DOCUMENTS

| | | | |
|---|---|---|---|
| 4,223,801 | 9/1980 | Carlson | 221/3 |
| 4,367,955 | 1/1983 | Ballew | 368/10 |
| 4,419,016 | 12/1983 | Zoltan | 368/10 |
| 4,483,626 | 11/1984 | Noble | 368/10 |
| 4,504,153 | 3/1985 | Schollmeyer et al. | 368/10 |
| 4,768,176 | 8/1988 | Kehr et al. | 368/10 |
| 4,837,719 | 6/1989 | McInosh et al. | 364/569 |
| 4,905,213 | 2/1990 | Masse et al. | 368/10 |
| 4,942,544 | 7/1990 | McIntosh et al. | 364/569 |
| 4,970,669 | 11/1990 | McIntosh et al. | 364/569 |
| 5,016,230 | 5/1991 | Seifers et al. | 368/10 |
| 5,088,056 | 2/1992 | McIntosh et al. | 364/569 |
| 5,170,380 | 12/1992 | Howard et al. | 368/10 |
| 5,200,891 | 4/1993 | Kehr et al. | 364/413.01 |
| 5,239,491 | 8/1993 | Mucciacciaro | 364/569 |
| 5,341,291 | 8/1994 | Roizen et al. | 364/413.02 |
| 5,347,453 | 9/1994 | Moulding et al. | 221/71 |
| 5,408,443 | 4/1995 | Weinberger | 368/10 |
| 5,412,372 | 5/1995 | Parkhurst et al. | 340/568 |
| 5,495,961 | 3/1996 | Maestre | 331/3 |

*Primary Examiner*—Jeffery Hofsass
*Assistant Examiner*—Julie B. Lieu
*Attorney, Agent, or Firm*—Robert J. Hess, Esq.; Cobrin Gittes & Samuel

[57] ABSTRACT

A programmable time interval alarm that has a plurality of switches or buttons to set the alarm interval. Each button corresponds to a different time interval setting. In this manner, the alarm is simply programmable by actuating a single button corresponding to the desired interval. The alarm has a housing with a resilient element such as a rubberized inner surface to compress against containers of different dimensions and be clamped into position to move with the container.

23 Claims, 4 Drawing Sheets

SELF-CONTAINED, PROGRAMMABLE, TIME INTERVAL ALARM REMINDER DEVICE FOR EYEDROP MEDICATION ADMINISTRATION AND A MEANS FOR AFFIXING SUCH TO EYEDROP/ MEDICATION CONTAINER

BACKGROUND OF THE INVENTION

1. Field of the Invention

The present invention relates to an alarm device that makes a visual and/or auditory indication at time intervals and is adapted to hold onto a medication container, such as one containing eyedrops or pills.

2. Discussion of Related Art

Alarm devices for signaling the time when to take medication are conventional. Such alarm devices have been secured to containers of pills or eyedrops. In an effort to accommodate varied schedules for taking the medication contained in the pills or eyedrops, these alarms have become cumbersome to program. Some require that the time of day be set before the alarm can function. Others are multifaceted to accommodate setting off an alarm for taking a variety of different types of medication at different times throughout day. In other words, many have some type of programmable clock that needs to be set; such clock timing circuitry is well known conventionally and is used in a number of consumer items.

For instance, such clock timing circuitry is found in video cassette recorders (VCRs). Surveys have found that most consumers do not know how to program the timer on their VCRs to record programs. Applying the same sort of technology to alarms for taking medication, therefore, is equally confusing to the consumer or at least cumbersome to program. Indeed, many elderly persons who are on medication may never have used such programming technology before and are therefore intimidated by it. Even pharmacists or physicians may not have the necessary skills to program them and thus may shy away from recommending them to patients.

There are medication reminder alarm mechanisms, however, that allow the time interval to be set by turning on an appropriate switch, but such mechanisms fall to hold onto a medication container such as the one typically provided by a pharmacist. Furnishing a separate medication compartment to go with the alarm both adds to the overall cost and slows down use, because the medication has to be transferred from the container it came in to the separate medication compartment that accompanied the alarm mechanism.

It would therefore be desirable to provide an alarm reminder device for taking medication that is user friendly in the sense of being readily programmable and which does not require one to set the time of day to program. Further, it is desired that such an alarm reminder be readily secured to a container of medication, thereby eliminating the expense of providing a separate one and the inconvenience of transferring medication from one to the other.

SUMMARY OF THE INVENTION

The present invention relates to an alarm reminder device that is programmable to set any one of a variety of time intervals for sounding the alarm or otherwise making an indication by actuating a single key or button. The alarm reminder device has a housing that holds onto a periphery of a container of medication by compressing a resilient element, such as a rubberized inner facing surface, and may close a clamp to secure the housing to the container as the resilient inner facing surface compresses.

BRIEF DESCRIPTION OF THE DRAWING

For a better understanding of the present invention, reference is made to the following description and accompanying drawings, while the scope of the invention is set forth in the appended claims.

DESCRIPTION OF THE PREFERRED EMBODIMENT

Figure 1:
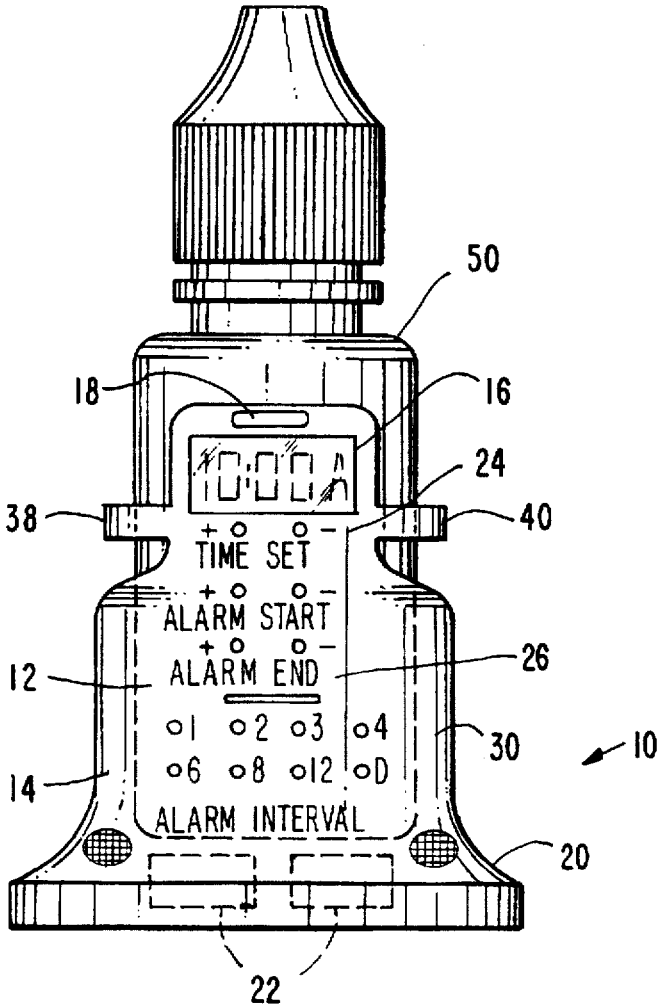
FIG. 1 shows an elevational view of the alarm reminder device of the present invention with a container of eyedrop medication held in position.

Turning to the drawings, FIG. 1 shows an alarm reminder device 10 with an alarm panel 12. The panel includes buttons 14, a clock time display 16, a flashing light indicator 18, speakers 20 for sounding the alarm, batteries 22 and buttons 24 for setting the clock time display, and buttons 26 for activating or shutting off the alarm.

The buttons 14 include those responsible for setting the alarm interval. Each button 14 corresponds to a different time interval, such as every hour, two hours, three hours, four hours, six hours, eight hours, 12 hours and daily. These represent the most common set of time intervals prescribed for taking medication that are generally recommended. Other time intervals may also be added. Since each button 14 represents a different time interval, all that is necessary is to actuate one appropriate button 14 and the alarm interval is set. The actual time of day is unimportant, but the interval can be coordinated to begin and end at specific times of the day.

The buttons can be labelled as shown as well as color coded to reduce the chance of incorrect programming. A color coded chart can be provided for the user to refer to. The timing device housing for eyedrops can be color coded as well to correspond to the Industry Standard colors of the various eyedrop container caps (see chart below). This would help to diminish the risk of a patient confusing one medication for another if multiple medications are prescribed.

Yellow—Betablockers

Green—Pilocarpine

Violet—Propine

Orange—CAI-inhibitors

Red—Mydriatics

White—Antibiotics

The alarm device is programmable either by the pharmacist, doctor or the patient. In the event that the frequency for taking the medication changes at some later date, the alarm is easily reprogrammable by actuating the appropriate button 14.

The alarm, when triggered upon the passage of the set interval of time, sounds an alarm that is heard through the speakers 20 and makes a visual indication by the flashing light indicator 18. The alarm may be factory set to enunciate for a fixed time period, such as one minute. Provision may be made for shutting off the alarm by the consumer, by pressing a specially dedicated button.

As concerns the alarm on-off button 26, a plus sign by one of the buttons may designate turning on the alarm sounding while a negative sign by the other of the buttons could designate shutting off the alarm sounding. If the alarm sound is shut off, the flashing light indicator 18 will continue to flash when actuated as the set time interval arrives. Thus, persons who prefer not to listen to the alarm sound may still be advised of the time to take the medication solely by the flashing light indicator 18. A vibrator mechanism can also be incorporated to assist those with impaired hearing, sight or both.

As an additional option, a clock time display 16 may be provided to keep track of the time of day, perhaps for correlating the time of day with the taking of the medication. A set of buttons 24 is provided for setting the time in a conventional manner, i.e., with two buttons, one marked with a plus sign to increment the time and the other marked with a negative sign to decrement the time.

Figure 5:
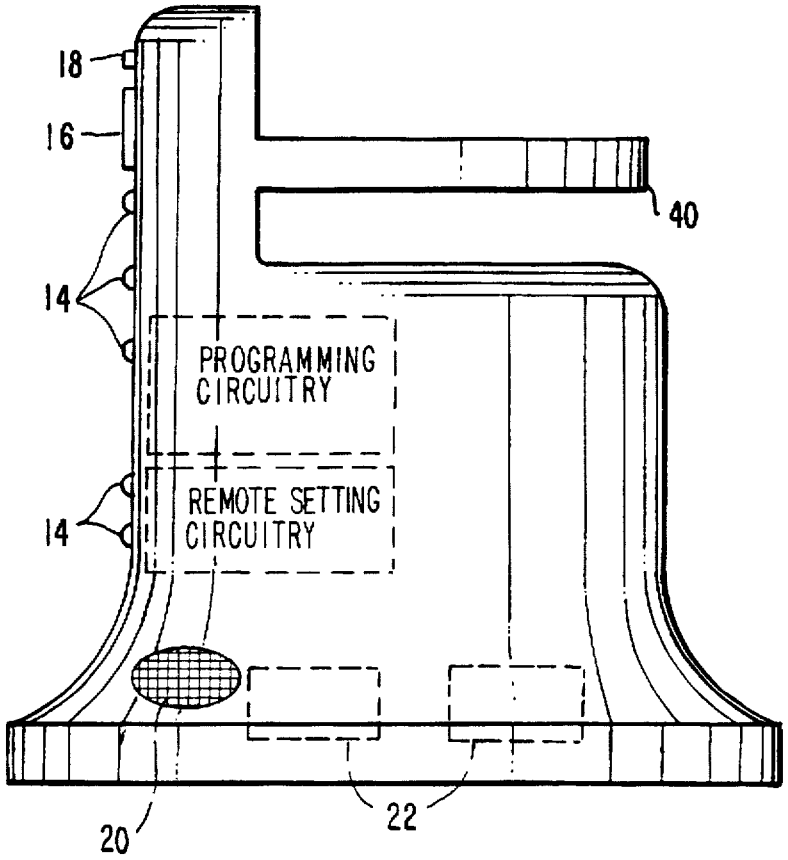
FIG. 5 is analogous to the view of FIG. 3 but without the bottle and further identifying circuitry.

Once the time interval is set, the alarm will make an indication upon the arrival of the end of the programmed time interval. The patient then takes the medication and may then wait until the alarm sounds again during passage of the next interval before taking the medication again. In a conventionally understood manner, such as that found in digital watches with electronic stop watches and electronic displays that alternate the display of the time of day with other information such as the day of the week or date, the display 16 could alternatively display the time of day and the set time interval or could count down the time remaining before the current time interval ends or the time elapsed from commencement of the interval. FIG. 5 identifies programming circuitry for causing the display 16 to make a visual indication of counting any one of the time remaining and time elapsed.

If a patient must take multiple medications, then separate alarm devices of the present invention may be used each dedicated to serve individual containers of the medications. Thus, there would be, for instance, five alarm devices for five different medication containers each set to make an indication upon the passage of a time interval corresponding to the medication concerned.

Since containers that contain pills or eyedrops come in a variety of sizes, the alarm is adapted to fit a range of container sizes. The present invention envisions any conventional technique for securing a container to a wrap-around type element.

Figure 2:
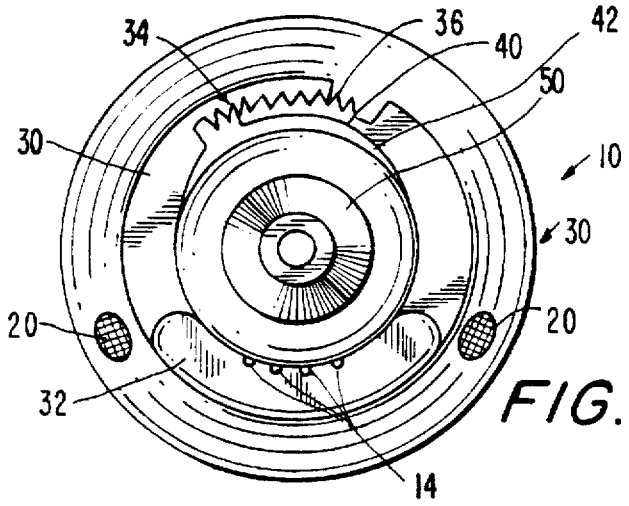
FIG. 2 shows a top view of the alarm reminder holding clamp, but without the container.
Figure 3:
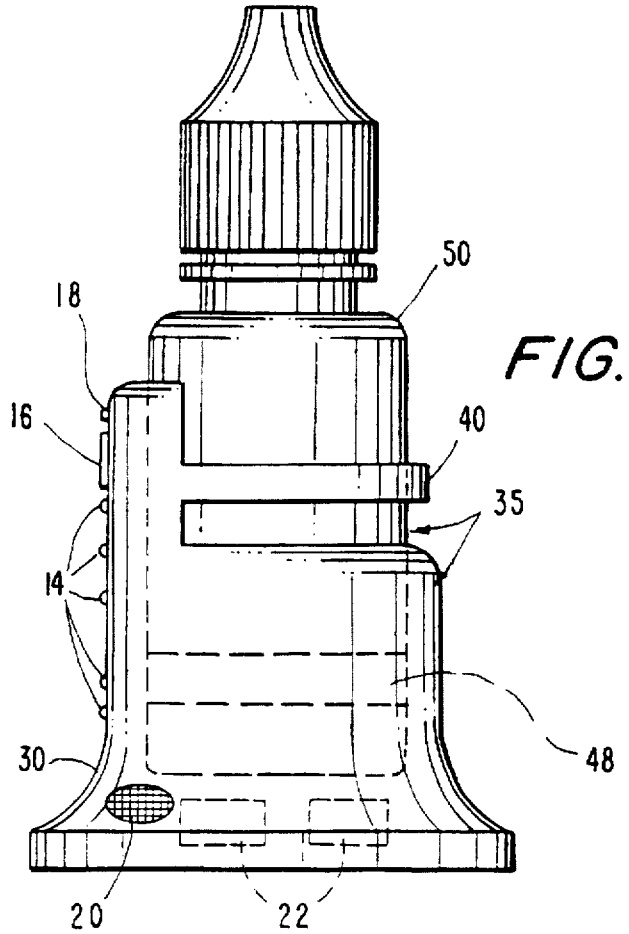
FIG. 3 is an elevational view taken from the right of FIG. 1 and which is symmetrically identical to the view taken from the left thereof.

For instance, FIGS. 1–3 illustrate a suitable manner to effect securement. As shown, alarm reminder device 10 includes a holder housing 30, perhaps made of plastic, an elastic inner facing surface 32, and a clamp 34. The clamp 34 may have releasable ratchet teeth 36 that lock with each other in a conventional manner. The housing 30 is spilt to form a vertically extending gap 35 (FIG. 3) that extends vertically away from the clamp 34, but the gap or split also continues circumferentially at the clamp to permit two extending clamp arms 38, 40 to mate their mating elements, namely, ratchet teeth 36 with each other. The arms 38, 40 extend in opposite directions circumferentially.

The elastic inner surface 32 compresses under pressure but resiliently returns to its original shape after the pressure is released. The elastic inner surface 32 may completely line the inwardly facing surface of the housing 30 to form a cylinder or else line only a portion of the inwardly facing surface, perhaps being confined to form a ring or a ring segment that is arranged diametrically opposite the engaged teeth 36. The inner surface may be constructed of any elastic, resilient material such as silicone rubber. Alternatively, or in addition to providing an elastic inner surface 32, the arms 38, 40 may be constructed of an elastic, resilient material that squeezes onto the medication container 40 as the arms clamp to each other.

The medication container 50 (see FIG. 1) is inserted bottom side down into the hollow space or well 42 (see FIG. 2). To accommodate containers of different heights, a spacer 48 may be inserted into the hollow space or well 42 towards the bottom. The elastic inner surface 32 is squeezed against the periphery of the container 50 by mating the ratchet teeth with each other, i.e., by pushing the arms 38 in opposite directions circumferentially so as to reduce the dimension of the space 42. To remove the container 50 from the hold of the arms, the arms may be released from each other in any conventional manner. For instance, removal may be effected by pulling the outermost one of the arms 38, 40 radially outward from the other to effect separation of the mated ratchet teeth.

Timing circuitry for setting and sounding alarms is known conventionally to assist in the taking of medication, e.g., based on the following patents whose contents are incorporated by reference.

| U.S. Pat. No. | U.S. Pat. No. |
|---|---|
| 5,412,372 | 4,970,669 |
| 5,408,443 | 4,942,544 |
| 5,347,453 | 4,905,213 |
| 5,344,043 | 4,837,719 |
| 5,341,291 | 4,768,176 |
| 5,239,491 | 4,504,153 |
| 5,200,891 | 4,483,626 |
| 5,088,056 | 4,419,016 |
| 5,016,230 | 4,367,955 |
| 5,012,496 | 4,223,801 |

The present invention may be incorporated into the teachings of any of these patents to provide the additional feature of setting the time interval by actuation of a single button.

For instance, U.S. Pat. No. 4,905,213 teaches the use of a clock with buttons adjacent each of the hours of the clock face. By actuation of a corresponding button by the hour or the dial, the time is readily set for the alarm to sound. However, there is no separate button that may be activated to set the interval. The present invention, therefore, could be incorporated by setting the interval through actuation of an appropriate interval button that takes into effect upon commencement of the hour on the dial corresponding to the button on the clock fact that was actuated.

Thus, the user could press the 9:00 button on the clock face according to U.S. Pat. No. 4,905,213 and then the four hour interval button according to the present invention so that the alarm makes an indication at 1:00, 5:00, 9:00 and every four hours thereafter. As an option, a further button may be available for sleep mode so that the alarm does not sound during the typical sleeping hours such as between 11:00 p.m. and 7:00 a.m. or some other hourly interval range.

U.S. Pat. Nos. 5,408,443; 5,344,043; and 5,341,291 teach techniques for programming alarms remotely such as over the phone. Such techniques may be built into the present invention, but modified so that the time interval is changed remotely and preferably by transmitting a single code that is interpreted as direction to change the time interval accordingly. FIG. 5 identifies remote setting circuitry suitable to remotely set the time interval.

U.S. Pat. No. 4,483,626 teaches the use of a timing mechanism that has a selector switch that allows setting the time interval manually for sounding the alarm. The present invention could be incorporated into its teaching by replacing its selector switch dial with buttons of the present invention and further adapting it to hold onto the periphery of a container of medication by compressing a resilient element in the manner of the present invention instead of adding to the expense of manufacture by relying on attaching modular container compartments.

The preferred embodiment of the present invention employs buttons, but the buttons may be of any conventional configuration, whether actuated in response to pressing, sliding, pulling or rotating or being touch sensitive. Buttons are preferred because they are faster to program by pressing than by turning a selector dial for instance to the appropriate setting and also easier to manipulate by those having limited finger dexterity (e.g., due to arthritis). Such buttons include, for instance, knobs and keys. For the sake of encompassing more than just buttons, the present invention envisions covering any form of switches that close an electrical circuit, of which buttons are a particular type. A rotatable dial selector of the type of U.S. Pat. No. 4,483,626 is another type of actuation device that uses switches.

Figure 4:
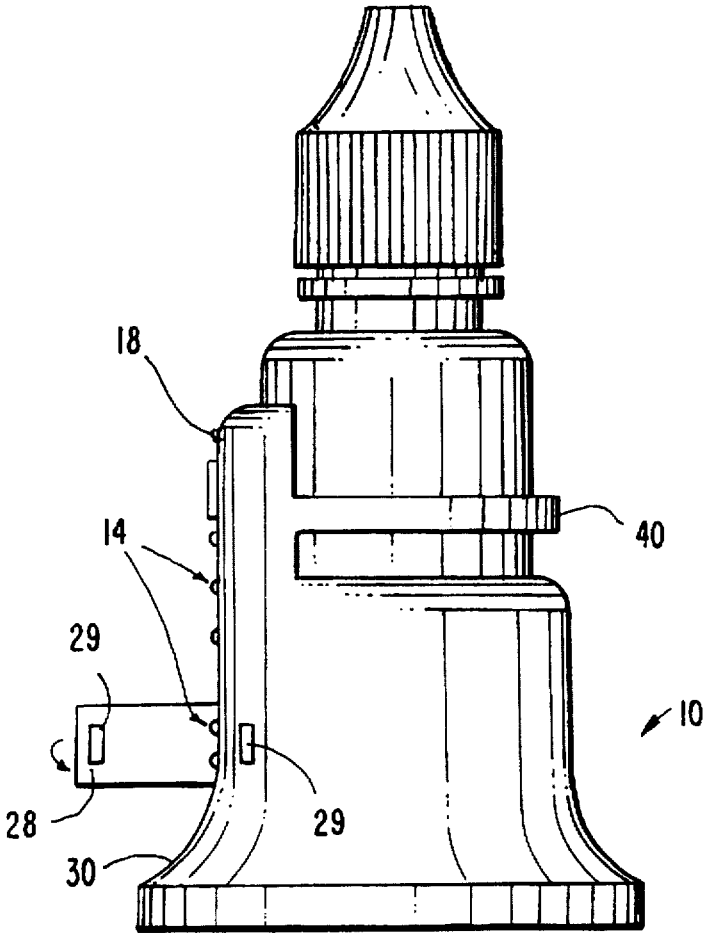
FIG. 4 is the same view as FIG. 1 (but in outline) to show an open door position.

FIG. 4 shows that a hinged door panel 28 may be provided to swing between an open position that renders the alarm panel with buttons 14 accessible and a closed position that renders the alarm panel inaccessible. In this manner, with the hinged door 28 closed, the buttons 14 are protected by the hinged door panel 28 against inadvertent actuation of the buttons. The door may be retained in the closed position in any conventional manner, such as with fastener material 29 in the form of interacting and engaging fibrous loops and hooks.

Instead of being hinged, the door panel could be connected to the housing so as to slide between the open and closed positions by sliding in a friction fit manner between grooved parallel guides (not shown). Any conventional technique for moving the door panel may be employed, e.g. rotating the door panel about a pivot.

While the foregoing description and drawings represent the preferred embodiments of the present invention, it will be understood that various changes and modifications may be made without departing from the spirit and scope of the present invention.

What is claimed is:

1. A self-contained programmable time interval alarm device for medication administration, comprising:

a wrap-around housing having a resilient element and a clamp with releasably mating elements, said wrap-around housing being movable to wrap around a periphery of a container of medication, said clamp being movable in unison with said wrap-around housing between a clamping position, which mates said releasable mating elements and secures the container of medication to said housing, and a released position that frees said releasable mating elements and releases the container from said wrap-around housing, said resilient element compressing into a compressed condition in response to said clamp entering into said clamping position and thereby being movable in unison with said container, said resilient element leaving said compressed condition in response to said clamp entering into said released position;

alarm circuitry supported by the housing and being responsive to passage of a set time interval to make an indication; and a plurality of switches supported by the housing each associated with a different time interval, said alarm circuitry being responsive to actuation of any of said switches individually to set to the different time interval that is associated with the switch so that the alarm circuitry makes the indication in response to passage of the different time interval.

2. A device as in claim 1, wherein said housing has an inner facing side, said resilient element being secured to said inner facing side to press against the periphery of the container to hold onto the same.

3. A device as in claim 1, further comprising a color coding neighboring said switches so that each has a different color.

4. A device as in claim 1, wherein said alarm circuitry includes clock circuitry, further comprising a display responsive to the clock circuitry for displaying a time of day.

5. A device as in claim 1, further comprising a door panel connected to the housing, said door panel being movable between an open position to allow access to said switches and a closed position to prevent inadvertent manipulation of said switches.

6. A device as in claim 1, wherein said housing has a top defining an opening and a bottom that is closed so that the housing shrouds the container as the container is inserted through the opening and is moved toward the bottom until the container sits on a topside of the bottom.

7. A device as in claim 1, wherein said alarm circuitry includes at least one of an audible indicator, a visual indicator and a vibratory indicator each actuated in response to passage of the time interval.

8. A device as in claim 1, wherein said alarm circuitry includes clock circuitry, further comprising a time key actuated to designate an hour of a day as clocked by said clock circuitry, said corresponding one of said time intervals commencing from the hour of the day designated by actuation of the time key.

9. A device as in claim 1, wherein said alarm circuitry includes remote setting circuitry to change the selected one of the plurality of different time intervals remotely to another time interval and set the same in response to the change.

10. A device as in claim 1, wherein said releasable mating elements of said clamp are mating ratchet teeth.

11. A device as in claim 1, wherein said switches are part of a panel, said panel having legible markings associated with each of the switches that signifies different time intervals.

12. A device as in claim 4, wherein said display makes an indication of the time interval set.

13. A device as in claim 4, wherein said alarm circuitry is programmed to cause said display to make a visual indication of counting any one of time remaining and time elapsed in the time interval.

14. A device as in claim 1, wherein the housing has a gap through which access to the periphery of the container is provided through the housing to dispense the medication by squeezing the container.

15. A device as in claim 1, wherein the housing defines a well into which the container is insertable, further comprising a spacer removably inserted in the well.

16. A device as in claim 1, wherein said housing is color coded to correspond with standard colors assigned to caps of eyedrop containers to signify medication contained within.

17. A device as in claim 1, wherein said switches are pushbuttons.

18. A method of reminding to take medication, comprising the steps of:

wrapping a housing about a periphery of a medication container, compressing a resilient element between the housing and the container in response to the step of wrapping, moving a clamp in unison with the wrap-around housing into a clamped position by mating releasable mating elements of the clamp together to secure said housing to said medication container so that the housing is movable together with the container;

selecting one of a plurality of switches and actuating the same to set a time interval, the switches being supported by the housing and each being associated with a different time interval;

in response to actuation of the switch, clocking the set time interval with clock circuitry that is supported by the housing; and making an indication upon completion of passage of the set time interval being clocked.

19. A method as in claim 18, further comprising the step of changing the time interval set by actuating a further switch.

20. A method as in claim 18, further comprising squeezing the container by accessing the container through a gap in the housing.

21. A method as in claim 18, wherein the step of making an indication includes making sensory stimulation with at least one of visual, auditory and vibratory stimuli.

22. A method as in claim 18, further comprising the step of selecting the alarm housing based on matching a color of the housing with a color of a cap of the medication container and then carrying out the step of holding with the housing and the cap whose color coding matches.

23. A method as in claim 18, wherein said clamp includes mating ratchet teeth that mate with each other to enter into said clamping position.

* * * * *